US006510655B1

(12) United States Patent
Antonini

(10) Patent No.: US 6,510,655 B1
(45) Date of Patent: Jan. 28, 2003

(54) DEVICE TO MOVE BLINDS OR JALOUSIES

(76) Inventor: Emilio Antonini, Via Romagna, 25, 34100 Trieste (IT)

( * ) Notice: Subject to any disclaimer, the term of this patent is extended or adjusted under 35 U.S.C. 154(b) by 0 days.

(21) Appl. No.: 09/718,798

(22) Filed: Nov. 22, 2000

(30) Foreign Application Priority Data

Oct. 11, 2000 (IT) ..... UD00A0190

(51) Int. Cl.[7] ..... E06B 7/086
(52) U.S. Cl. ..... 49/87.1
(58) Field of Search ..... 49/87.1, 64, 74.1, 49/77.1, 80.1, 92.1

(56) References Cited

U.S. PATENT DOCUMENTS 2,577,072 A * 12/1951 Cotner ..... 49/74.1
3,287,852 A * 11/1966 Belden ..... 49/74.1
5,187,896 A * 2/1993 Ross ..... 49/74.1
5,303,507 A * 4/1994 Oille ..... 49/74.1
5,548,925 A * 8/1996 Marocco ..... 49/74.1
6,041,547 A * 3/2000 Marocco ..... 49/87.1
6,125,581 A * 10/2000 Grossman ..... 49/74.1

* cited by examiner

*Primary Examiner*—David M. Purol
(74) *Attorney, Agent, or Firm*—Akin Gump Strauss Hauer & Feld, L.L.C.

(57) ABSTRACT

Movement device (10) to selectively close blinds or jalousies oscillating in a wing (25) for doors or windows, comprising at least a movement rod (14) able to be constrained to the blinds or jalousies (12) and a plurality of connection elements (15) each one able to join the rod (14) to each of the blinds (12); the connection element (15) comprises a rotary element (15*c*) including at least a pin element (23) able to be inserted into a mating hole (20) made in the relative blind (12), an anchorage element (15*a*) including a body able to be inserted into a seating (16) made in the inner side of the rod (14) and an intermediate element (15*b*) able to connect the rotary element (15*c*) and the anchorage element (15*a*), and with respect to which intermediate element (15*b*) the rotary element (15*c*) is able to rotate during the movement of the blinds (12).

14 Claims, 4 Drawing Sheets

DEVICE TO MOVE BLINDS OR JALOUSIES

FIELD OF THE INVENTION

The invention concerns a device able to selectively move jalousies or blinds in a wing for doors or windows, able to allow more or less light to pass.

The device according to the invention comprises at least a rod connected to each of the blinds by means of a relative articulated connection element.

BACKGROUND OF THE INVENTION

It is known that jalousies or blinds in the wings of doors or windows are pinned oscillating to a frame and can be selectively positioned in a first, substantially closed position, wherein they prevent the light from passing, or in a second, substantially open position, wherein they allow maximum light to pass.

This movement is usually performed by a rod arranged perpendicular to the blinds and connected to each of them by means of a little U-shaped hook attached to a relative blind.

In conventional embodiments, the movement rod comprises a rectilinear notch on the inner side along its whole length, able to house a metal blade which protrudes slightly from the surface of the rod. The blade has a series of holes with a constant pitch, and there are as many holes as there are blinds to be moved; the holes are aligned along the movement rod and able to house the curved segment of the little U-shaped hooks.

At their two opposite ends, the little hooks are partly threaded into a lateral side of the blinds to be moved so as to form a closed eyelet.

This conventional solution provides that, to move the blinds from a substantially closed position to a substantially open position, the movement rod is pulled or pushed, according to how the blinds are disposed; by means of the coupling between the holes and the little hooks, the movement rod simultaneously moves the blinds.

This conventional solution has some disadvantages, however, such as for example: the movement rod is not perfectly attached to the blinds and therefore it allows the rod to oscillate and consequently the tip of the rod may knock against something and get blocked.

Another disadvantage is that the little U-shaped hooks are inserted with a compressed-air pistol, and therefore they are rarely in the exact position for use, which causes malfunctioning and imperfections.

A further disadvantage concerns the imperfect closing of the blinds due to the excessive play between the movement rod and the little hooks; even in the closed position, this causes light to pass through the wing. Another disadvantage is that this system does not allow to close the blinds in a stable intermediate position between the open and closed positions.

A further disadvantage is that if metal elements holed with a constant pitch are used, they expand because of the heat, which over time leads to an imperfect closure, particularly of the last, lowest blinds in the wing.

The present Applicant has designed and embodied this invention to overcome these shortcomings of the state of the art, and to obtain further advantages.

SUMMARY OF THE INVENTION

The invention is set forth and characterized in the main claim, while the dependent claims describe other innovative characteristics of the invention.

The purpose of the invention is to achieve a device able to permit a plurality of selective screening elements, or blinds, in a wing for doors or windows, to move from a substantially open position to a substantially closed position, or in any intermediate position between these two limit positions, by means of articulated connection elements able to constrain a movement rod to each of said blinds. To be more exact, the purpose of the invention is to achieve a device able to maintain the rod stable and solid with its articulation points and with the blinds to be directed, in such a manner that there are no malfunctions or blockages in the movement.

Another purpose of the invention is to use elements which allow a simple, precise and fast assembly, which does not require accessory elements or assembly tools, thus limiting production, assembly and maintenance costs.

Another purpose of the invention is to allow to move blinds or jalousies also arranged with a variable pitch on the relative wing.

In the preferential embodiment, the device is applied to wings which have elements, frame, blinds and movement rod, which are all made of wood. This ensures a constant long-term functioning, because the thermal expansion coefficients of all the elements of the wing are the same, particularly those of the movement rod and the blinds.

The device according to the invention consists of a movement rod associated with a plurality of blinds or jalousies, mounted on the inner frame of a wing by means of a corresponding plurality of connection elements, or hinges, located between the blinds and the rod.

The movement rod is able to connect and move the blinds in parallel and simultaneously so that they can be selectively oriented to graduate the passage of light, or air, through the wing on which the device is mounted.

According to the invention, the connection element substantially consists of a rotary element able to be anchored on a relative blind, an intermediate element and an anchorage element able to attach itself to the movement rod. The elements are all made advantageously of plastic material.

The rotary element is substantially T-shaped and comprises a pin element on the surface of which, according to a variant, there are anchorage means, for example a knurling, an expansion notch, or other conventional means. The pin element of every connection element is able to be inserted and clamped through interference in a mating hole made in the relative blind. The pin element is constrained to the intermediate element by a pivot, orthogonal thereto, which allows it to rotate.

The intermediate element has a housing seating shaped so as to allow the rotary element to move through an angle of more than 180°. There are also two holes on the intermediate element, in which the pivot of the rotary element is hinged, with an extremely small tolerance so as to be able to stop the rotation of the rotary element in any position and to allow the static positioning of the blinds in any intermediate position between the open and closed positions.

The anchorage element is located behind the intermediate element with respect to which, in a preferential embodiment, it remains mis-aligned by some millimetres. This misalignment allows the movement rod to have as little contact with the frame as possible, when the device according to the invention is in the closed position. The anchorage element has lock-in means able to be inserted and clamped through interference in a relative seating made on one side of the movement rod. The lock-in means, in a preferential embodiment, consist of a thread comprising fins directed towards the bottom of the seating so that, after being inserted under pressure, they contrast the extraction and removal of the anchorage element from the rod.

By acting on the rod connected with the blinds by means of the connection elements, it is possible to selectively close the passage of light through the wing. In fact, by exerting a slight traction substantially downwards, the articulated connection elements act on the blinds and vary their orientation. This occurs with the rod quite solid with the blinds, since the small tolerance between the pivot and the holes of the head element, the possible means to attach the pin and the lock-in means of the anchorage element keep the rod and the blinds quite solid with each other, preventing them from oscillating or the tips from knocking and hence blocking any movement.

Moreover, the small tolerance allows the blinds to be positioned statically in any intermediate position between the open and closed positions.

BRIEF DESCRIPTION OF THE SEVERAL VIEWS OF THE DRAWINGS

These and other characteristics of the invention will become clear from the following description of a preferential form of embodiment, given as a non-restrictive example, with reference to the attached drawings wherein.

DETAILED DESCRIPTION OF THE INVENTION

Figure 1:
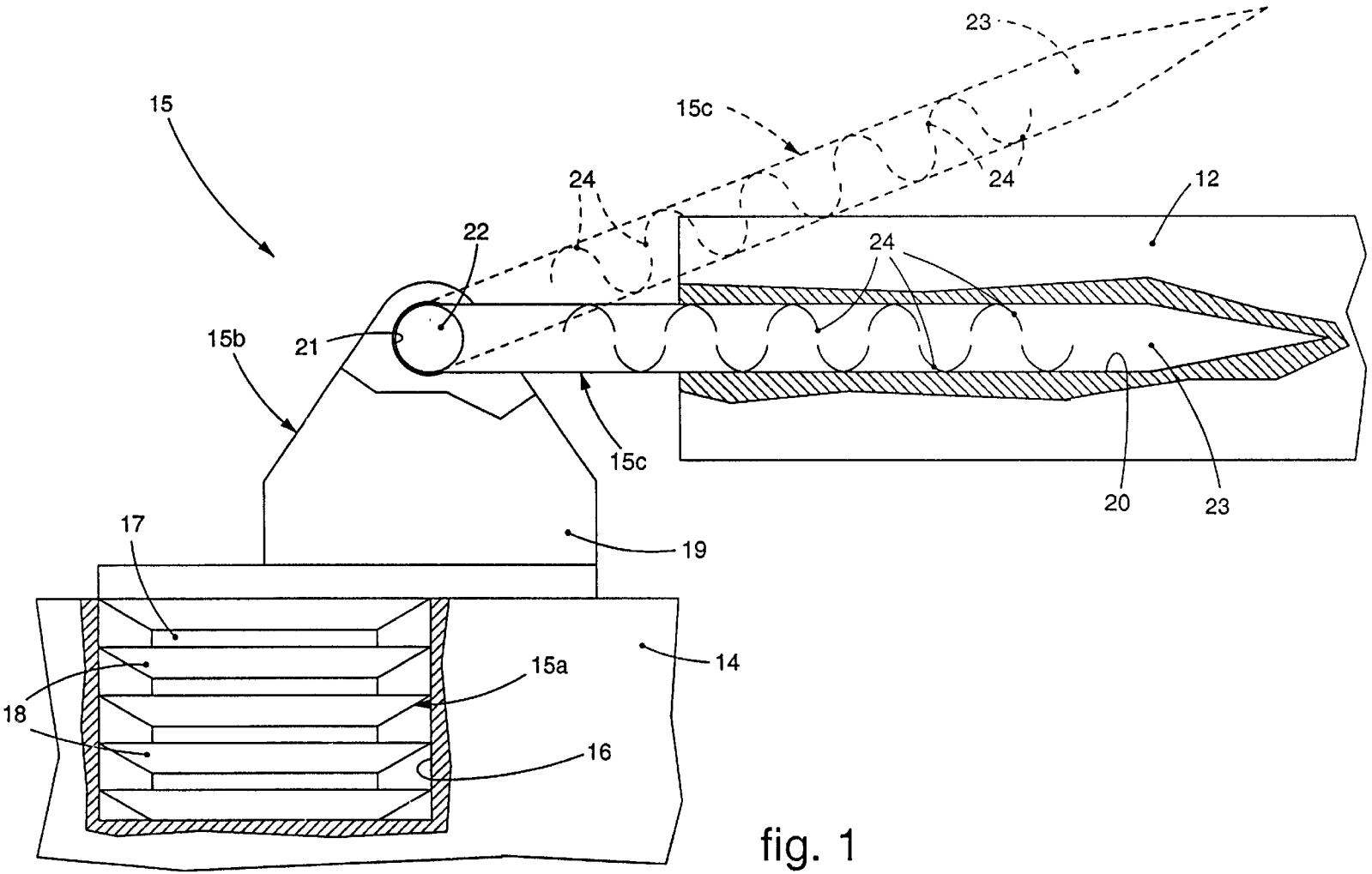
FIG. 1 shows a connection element of the device according to the invention.

With reference to the attached drawings, the number 10 denotes a movement device to selectively close blinds or jalousies according to the invention, able to vary the screening of the light or air through a wing 25 of a door or window.

The movement device 10 is associated with wings 25 consisting of a quadrangular wooden frame 11 having a gap 13 able to house a plurality of horizontal strips or blinds 12 able to be moved by a rod 14 arranged orthogonal to said blinds 12.

On its inner sides, the gap 13 has a series of holes (not shown in the attached drawings) able to accommodate mating pivots present in the blinds 12; on the upper side of the frame there is also a cavity 30 able to house the upper end of the rod 14 when the blinds 12 are in the closed position.

The blinds 12 oscillate on the relative pivots and prevent or allow more or less light or air to pass through the wing 25.

The movement device 10 comprises not only a movement rod 14 but also a plurality of articulated connection elements 15, one for each blind 12.

Each connection element 15 comprises a rotary element 15*c* able to be inserted under pressure and clamped into a mating hole 20 made on the relative blind 12, and an anchorage plug 15*a* able to be inserted under pressure and clamped into a mating seating 16 made on the inner side of the rod 14; the rotary element 15*c* and the anchorage plug 15*a* are connected by means of an intermediate element 15*b*, with respect to which said element 15*c* is free to rotate.

To be more exact, the anchorage plug 15*a* consists of a cylindrical body 17 with a plurality of flexible fins 18 facing downwards and able to be inserted under pressure into the relative seating 16; the particular orientation of the fins 18 renders them able to facilitate the insertion of the cylindrical body 17 into the seating 16 and to prevent it from coming out of said seating 16.

The intermediate element 15*b* substantially consists of a turret 19 which, in the embodiment shown in FIG. 1, has a vertical axis which is offset from a vertical axis of the cylindrical body 17, so as to allow the rod 14 to assume a lower position when it is closed. In this way, the cavity 30 can be smaller than those usually found.

Figure 4:
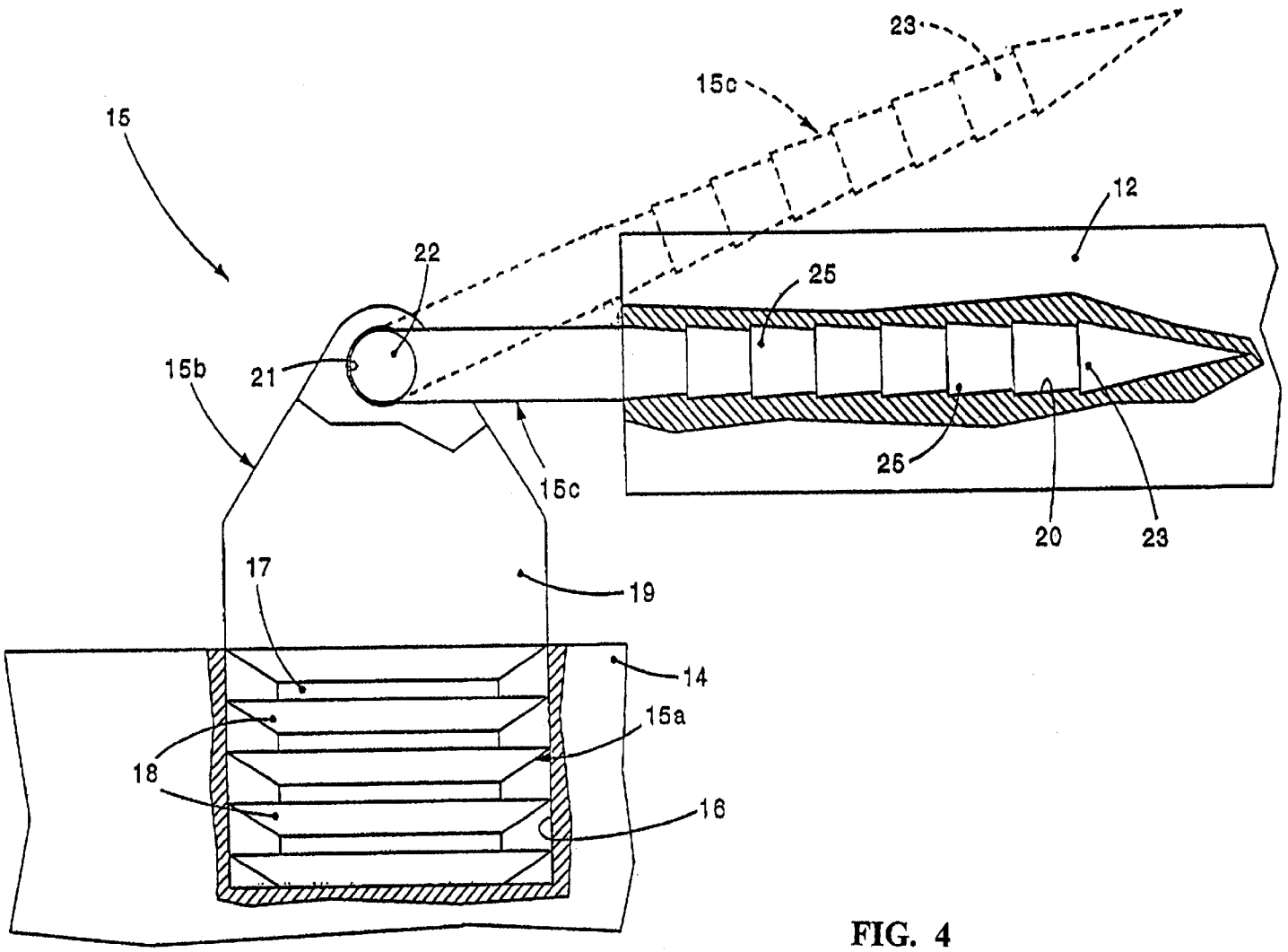
FIG. 4 shows a variant of FIG. 1.

It also comes within the field of the invention to position the turret 19 so that it is axially aligned with the axis of the cylindrical body 17. This embodiment is illustrated in FIG. 4.

The intermediate element 15*b* also comprises two holed seatings 21, which are opposite each other and able to contain a pivot 22.

At the rear part the rotary element 15*c* comprises said pivot 22 and at the front part a pin 23 which extends orthogonally with respect to the pivot 22. According to a variant, on at least part of its surface, the pin 23 has a knurling 24 or similar, which enables the pin 23 to be inserted under pressure into the relative hole 20 on the side of the blinds 12 with greater stability. The rotary element 15*c* is also able to rotate by about 180° thus allowing the blinds 12 to move by means of the rod 14.

Figure 2:
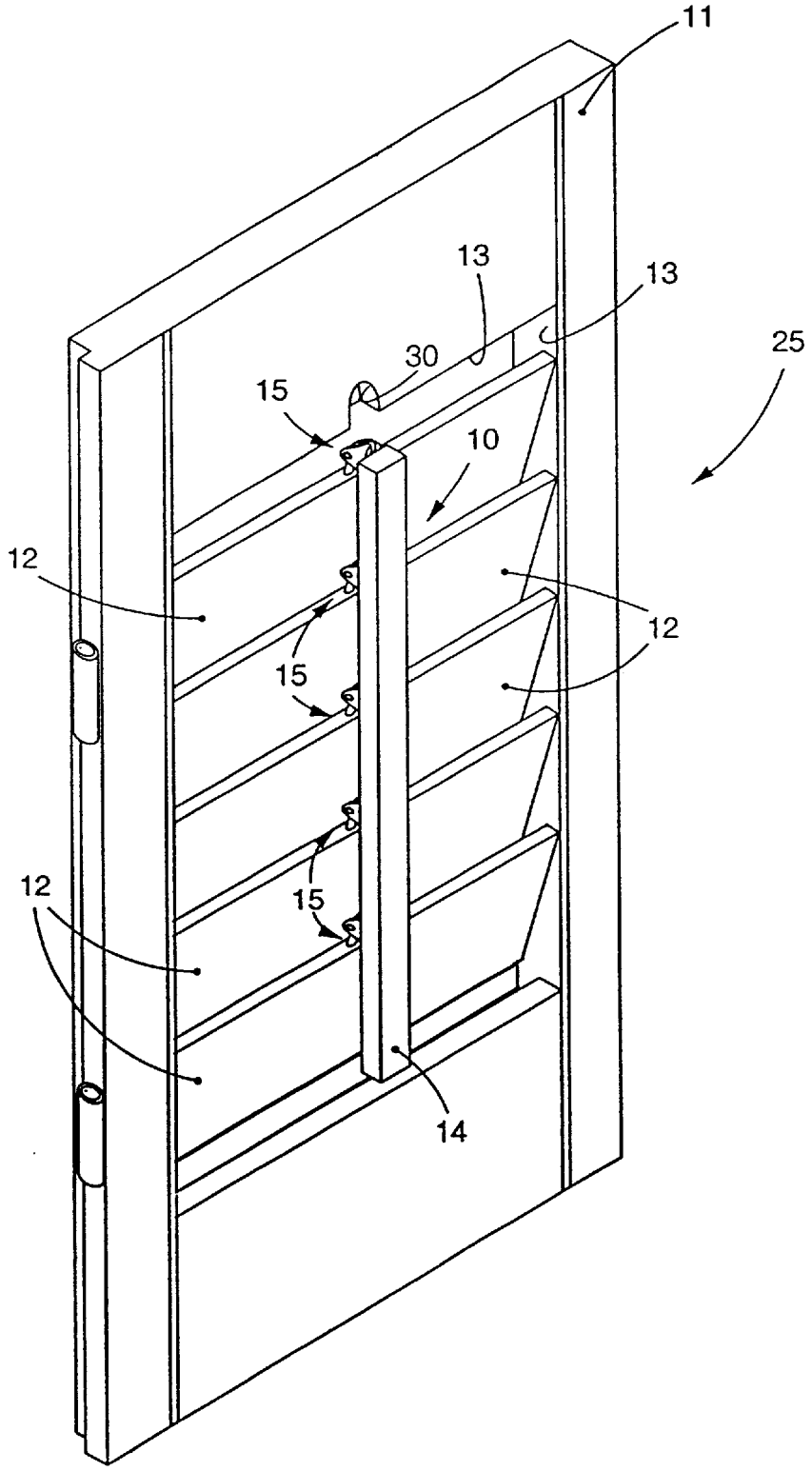
FIG. 2 is a three-dimensional view of the wing to which the invention is applied.
Figure 3:
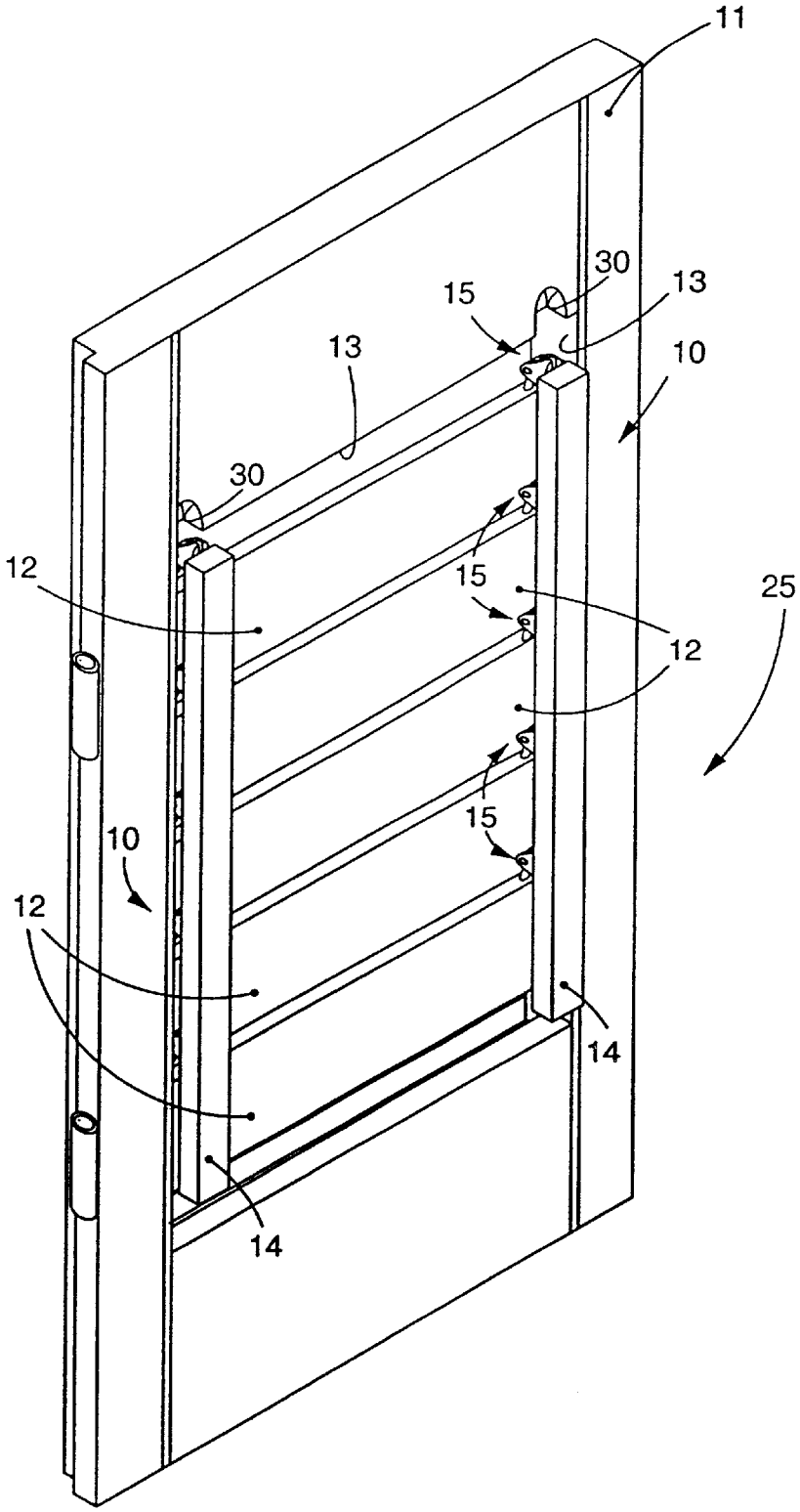
FIG. 3 shows a variant of FIG. 2.

In the variant shown in FIG. 3, there are two movement devices 10 according to the invention, arranged at the ends of the blinds 12 instead of at the center of the wing 25 as in FIG. 2. In this way, the relative rods 14 not only perform the typical movement function, they also perform the function of blocking out the light laterally in correspondence with the slit between blinds 12 and frame.

It is obvious however that modifications and/or additions may be made to the movement device 10 to selectively close blinds or jalousies as described heretofore, without departing from the spirit and scope of the invention.

For example, the pin 23 can have a larger diameter than the relative hole 20 and have a notch which will allow it to expand inside the hole 20.

In another variant, as illustrated in FIG. 4, the pin 23 has fins similar to those of the anchorage plug, with the same functions.

According to a further variant, the rod 14 is coupled with blinds 12 arranged with a variable pitch, instead of with a constant pitch as in the case shown here. This solution can be achieved in a much simpler way than in conventional solutions, since it only needs to make seatings 16 on the rod 14 with a variable pitch, mating with that of the blinds 12.

I claim:

1. Movement device for selectively closing blinds or jalousies oscillating in a wing for doors or windows, said movement device comprising at least a movement rod which is constrained to said blinds or jalousies and a plurality of connection elements, each one of which joins said rod to each of said blinds, wherein each said connection element comprises (a) a rotary element including at least a pin element which inserts and clamps into a hole in a blind, such that the rotary element is rotatably fixed to the blind, (b) an anchorage element including a body which inserts and clamps into a seating in said movement rod and (c) an intermediate element which connects said rotary element to said anchorage element, and wherein said rotary element rotates with respect to the intermediate element during movement of the blinds, and wherein said rotary element is generally rigid and includes a pivot arm extending from said pin element, wherein said pivot arm is substantially orthogonal to said pin element, and wherein said pivot arm allows said rotary element to rotate with respect to said intermediate element.

2. Movement device as in claim 1, wherein said pin element comprises interference means for maintaining said rotary element within a respective hole in the blind.

3. Movement device as in claim 2, wherein said interference means comprises a knurling.

4. Movement device as in claim 2, wherein said interference means comprises a notch which allows said pin element to expand inside said hole in said blind.

5. Movement device as in claim 1, wherein said intermediate element comprises a seating which allows said rotary element to rotate by at least 180° and two holes into which said pivot is clamped.

6. Movement device as in claim 1, wherein said anchorage element comprises lock-in means for clamping said anchorage element into said seating of said movement rod.

7. Movement device as in claim 6, wherein said lock-in means comprises a threading with fins facing toward the bottom of said seating of said movement rod.

8. Movement device as in claim 1, wherein an entire surface of said anchorage element is integral with said intermediate element.

9. Movement device as in claim 1, wherein a vertical axis of said anchorage element is offset from a vertical axis of said intermediate element.

10. Movement device as in claim 1, wherein a vertical axis of said anchorage element is aligned with a vertical axis of said intermediate element.

11. Movement device as in claim 1, wherein said rotary element, said intermediate element and said anchorage element are constructed of plastic.

12. Movement device as in claim 1, wherein said movement rod is constructed of wood.

13. Movement device as in claim 1, wherein said rotary element attaches to said intermediate element with a tolerance which allows said blinds to be statically positioned in any intermediate position between positions of a maximum opening and a maximum closing.

14. Movement device as in claim 1, wherein said movement rod has the connection elements arranged at a constant pitch with respect to each other.

* * * * *